US006990943B2

(12) United States Patent
Koyama

(10) Patent No.: US 6,990,943 B2
(45) Date of Patent: Jan. 31, 2006

(54) CYLINDER BLOCK OF AN ENGINE

(75) Inventor: Yoshinori Koyama, Osaka (JP)

(73) Assignee: Yanmar Co., Ltd., (JP)

( * ) Notice: Subject to any disclaimer, the term of this patent is extended or adjusted under 35 U.S.C. 154(b) by 0 days.

(21) Appl. No.: 10/640,302

(22) Filed: Aug. 14, 2003

(65) Prior Publication Data

US 2004/0079317 A1 Apr. 29, 2004

Related U.S. Application Data

(63) Continuation of application No. PCT/JP02/00398, filed on Jan. 21, 2002.

(30) Foreign Application Priority Data

Feb. 15, 2001 (JP) ..... 2001-38435
Feb. 15, 2001 (JP) ..... 2001-38436
Feb. 15, 2001 (JP) ..... 2001-38437

(51) Int. Cl.
*F02F 1/10* (2006.01)
*F02F 1/20* (2006.01)
*F02F 7/00* (2006.01)

(52) U.S. Cl. ..... 123/193.2; 123/195 H; 123/41.74; 123/196 R; 123/195 R

(58) Field of Classification Search ..... 123/195 R, 123/195 A, 195 H, 195 HC, 1 R, 41.72, 123/41.74, 193.2, 196 R, 196 M
See application file for complete search history.

(56) References Cited

U.S. PATENT DOCUMENTS 4,467,754 A * 8/1984 Hayashi et al. ..... 123/195 H
6,070,563 A * 6/2000 Achenbach et al. .... 123/195 R
6,196,181 B1 * 3/2001 Pong ..... 123/195 R
6,491,010 B2 * 12/2002 Kawamoto et al. ..... 123/196 R

FOREIGN PATENT DOCUMENTS

| | | |
|---|---|---|
| JP | 57-78745 | 5/1982 |
| JP | 59-115839 | 8/1984 |
| JP | 60-145237 | 9/1985 |
| JP | 63-150057 | 10/1988 |
| JP | 5-180070 | 7/1993 |
| JP | 6-55321 | 3/1994 |
| JP | 6-213064 | 8/1994 |
| JP | 10-77902 | 3/1998 |
| JP | 2001-152851 | 6/2001 |
| JP | 2001-221098 | 8/2001 |

OTHER PUBLICATIONS

International Search Report PCT/JP02/00398.*
Copy of English language International Search Report for Int'l Appl. No. PCT/JP02/00398, dated Apr. 30, 2002, 2 pages.

* cited by examiner

*Primary Examiner*—Willis R. Wolfe, Jr.
(74) *Attorney, Agent, or Firm*—Sterne, Kessler, Goldstein & Fox, P.L.L.C.

(57) ABSTRACT

A cylinder block for constituting an engine such as a diesel engine, comprises a cylinder portion (31) housing a piston (33); a curved skirt portion (32) covering a crankshaft (25); and ribs (61,62) formed on the inside of the skirt portion (32).

19 Claims, 15 Drawing Sheets

CYLINDER BLOCK OF AN ENGINE

BACKGROUND OF THE INVENTION

1. Field of the Invention

The present invention relates to the structure of a cylinder block constituting an engine.

2. Related Art

A cylinder block is one of media which transmit the explosive power to a crank system, and the most important structural member which must support the inertia load etc. of the crank system. Moreover, the structure of the cylinder block influences size, weight, whole durability, noise, etc. of the engine.

Conventionally, an art for increasing thickness of a cylinder portion is mainly applied as an art for improving the rigidity of the cylinder block which constructs an engine.

For example, in the Japanese Patent Laid Open Gazette 2001-221098, a large range portion such as a portion from the same side with a crankcase to the center in the cylinder block is constructed thickly so that the art for improving the rigidity of the cylinder block is disclosed. The art for improving the rigidity of the cylinder block is disclosed also in the Japanese Patent Laid Open Gazette Hei. 6-213064, where many portions of the cylinder block are constructed thickly.

However, when the cylinder block is formed thickly in a wide range thereof, the weight of the engine increases. Conversely, when the cylinder block is formed thinly for weight saving, the rigidity of the cylinder block is reduced, thereby increasing the noise of the engine.

Therefore, it is desired that the noise and weight of the engine are decreased while the rigidity of the cylinder block is enhanced.

A cooling-water gallery is constructed in the cylinder block so as to surround a cylinder, and cooling-water flows in the cooling-water gallery so that the cylinder is cooled. A drain hole of the cooling-water gallery is formed in the cylinder block and open on the side surface of the cylinder block. However, the drain hole is not disposed in the bottom of the cooling-water gallery. The cooling-water gallery of the cylinder block is disposed higher than a lubricating-oil gallery considering its arrangement relationship with the lubricating-oil gallery constructed within the cylinder block.

However, as disclosed, for example in the Japanese Patent Laid Open Gazette 2001-152851, only cooling of the cylinder like the temperature control of the cylinder wall is considered for the cooling-water gallery constructed in the conventional cylinder block. The cooling of lubricating-oil etc. circulating in the cylinder block is not considered especially. Moreover, since the drain hole of the cooling-water gallery is constructed higher than the bottom thereof, it is difficult to drain cooling-water completely. In case cooling-water remains within the cooling-water gallery for a long time, there is the possibility that degradation of the cylinder block might occur.

Furthermore, in the cylinder block formed by casting, the periphery of a hole formed by a member supporting a core is tapered, and a plug is installed in the hole.

In case the plug is installed in the hole after the hole is tapered by the member supporting the core, there is the possibility of change in the installing position of the plug according to the casting state of the cylinder block, so the labor and time are required in order to improve the precision of installing the plug.

SUMMARY OF THE INVENTION

A cylinder block of an engine according to the present invention comprises a cylinder portion housing a piston; and a skirt portion covering a crankshaft, wherein the skirt portion is curved and a rib is formed on the inside of the skirt portion.

Due to the shape of the skirt portion, noise emitted from the skirt portion is reduced without increasing the thickness of the cylinder block, thereby enabling an engine to be compact while ensuring silence of the engine.

In the cylinder block according to the present invention, a vertical rib formed in the skirt portion is provided from a lower end of a cylinder-liner of the cylinder block to a lower or bottom end of the skirt portion.

Therefore, rigidity of the cylinder block is enhanced at the cylinder-liner portion thereof and a bottom surface thereof fitted to a spacer.

The cylinder block of an engine according to the present invention further comprises a boss for attaching an engine base to the cylinder block, wherein a vertical rib is formed in the skirt portion continuously from the boss.

Therefore, rigidity of the boss in the cylinder block is enhanced, thereby restraining deformation of the cylinder block when the engine base is attached to the cylinder block, and improving precision of assembling the engine.

A cylinder block of an engine according to the present invention comprises a cylinder portion housing a piston; a skirt portion covering a crankshaft; a plugged hole formed in the cylinder portion; and a rib, wherein the skirt portion is curved and a rib is formed on the outside of the cylinder block so as to be connected with the plugged hole.

Therefore, rigidity of the cylinder block is enhanced at a portion thereof close to the plugged hole, thereby restricting deformation of the cylinder block and improving precision of assembling the engine.

A cylinder block according to the present invention comprises a cylinder portion housing a piston; a skirt portion covering a crankshaft; a surface facing a flywheel; a surface to be connected to a gear case; and journal housings for supporting the crankshaft, wherein the journal housings on respective sides of the cylinder block toward the surfaces are thickened at the upper portions thereof.

Therefore, rigidity of the cylinder block is enhanced so as to restrict deformation of the cylinder block when crank journals are attached into the journal housings and to improve the precision of assembling the engine. Moreover, the rotational stability of the crankshaft is secured and the silence of the engine is improved.

A cylinder block according to the present invention comprises a cylinder portion housing a piston; and a skirt portion covering a crankshaft, wherein a water jacket is disposed in the cylinder portion and extends into the skirt portion.

Therefore, the capacity of the water jacket is increased so as to enhance the cooling effect thereof. Moreover, the cooling effect to the crankcase portion is improved, and noise from the inside of the cylinder block is shut off, thereby attaining the noise reduction.

The cylinder block of an engine according to the present invention further comprises a lubricating-oil gallery, wherein the water jacket is extended to a point below the lubricating-oil gallery.

Therefore, an area of the lubricating-oil gallery contact with the water jacket is increased, thereby improving the cooling effect to the lubricating-oil gallery.

The cylinder block according to the present invention further comprises a drain hole of cooling water provided below the lubricating-oil gallery. Therefore, the cooling effect to the lubricating-oil gallery is improved over the upper and lower sides thereof. Cooling water is easily and perfectly drained from the cooling-water gallery, thereby improving maintainability. The cooling-water is prevented from remaining in the cooling-water gallery, thereby preventing degradation of the cylinder block.

A cylinder block according to the present invention comprises a cylinder portion housing a piston; a skirt portion covering a crankshaft; and a portion to be plugged, wherein a cast surface of the portion to be plugged is spot-faced. Therefore, installation of a plug into the hole is improved so as to facilitate processing of an engine. Moreover, precision of the installed plug is improved so as to improve the durability of the engine.

BRIEF DESCRIPTION OF THE DRAWINGS/FIGURES

Figure 4:
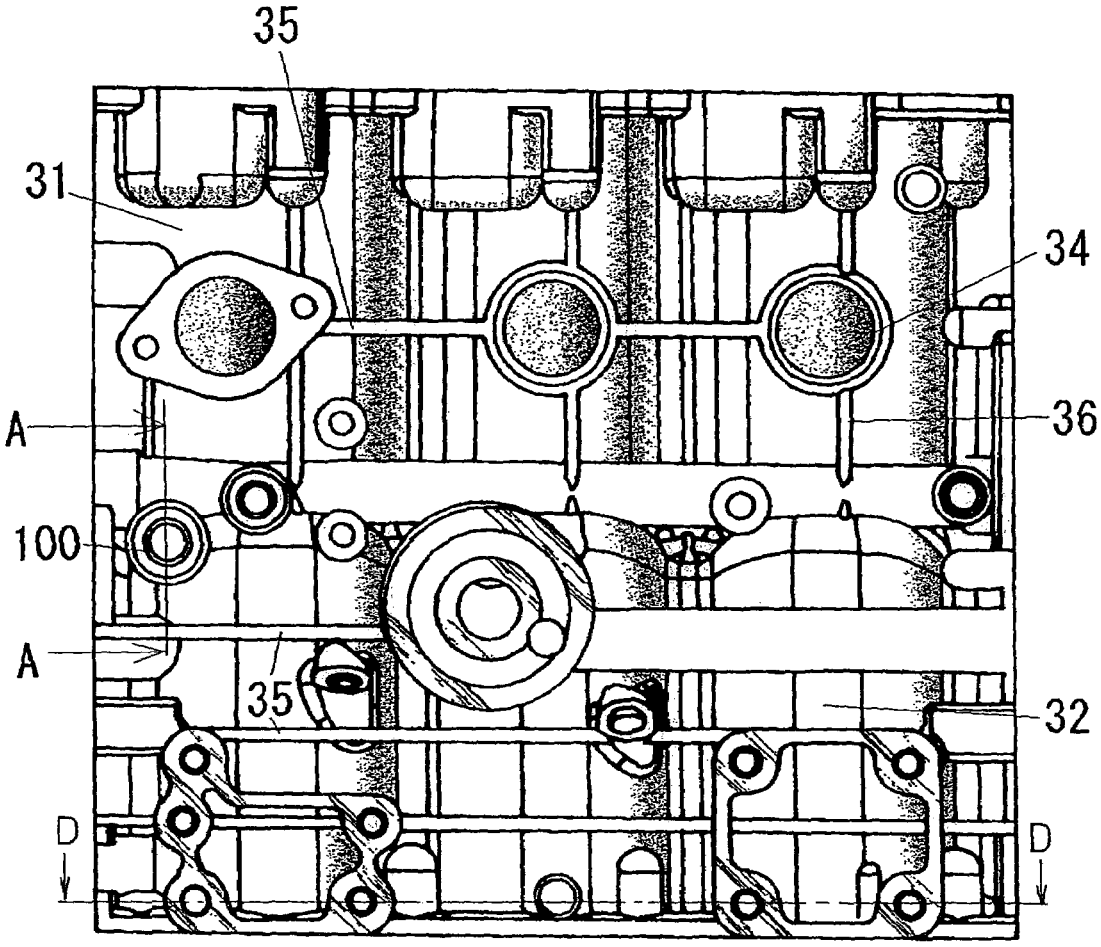
Figure 5:
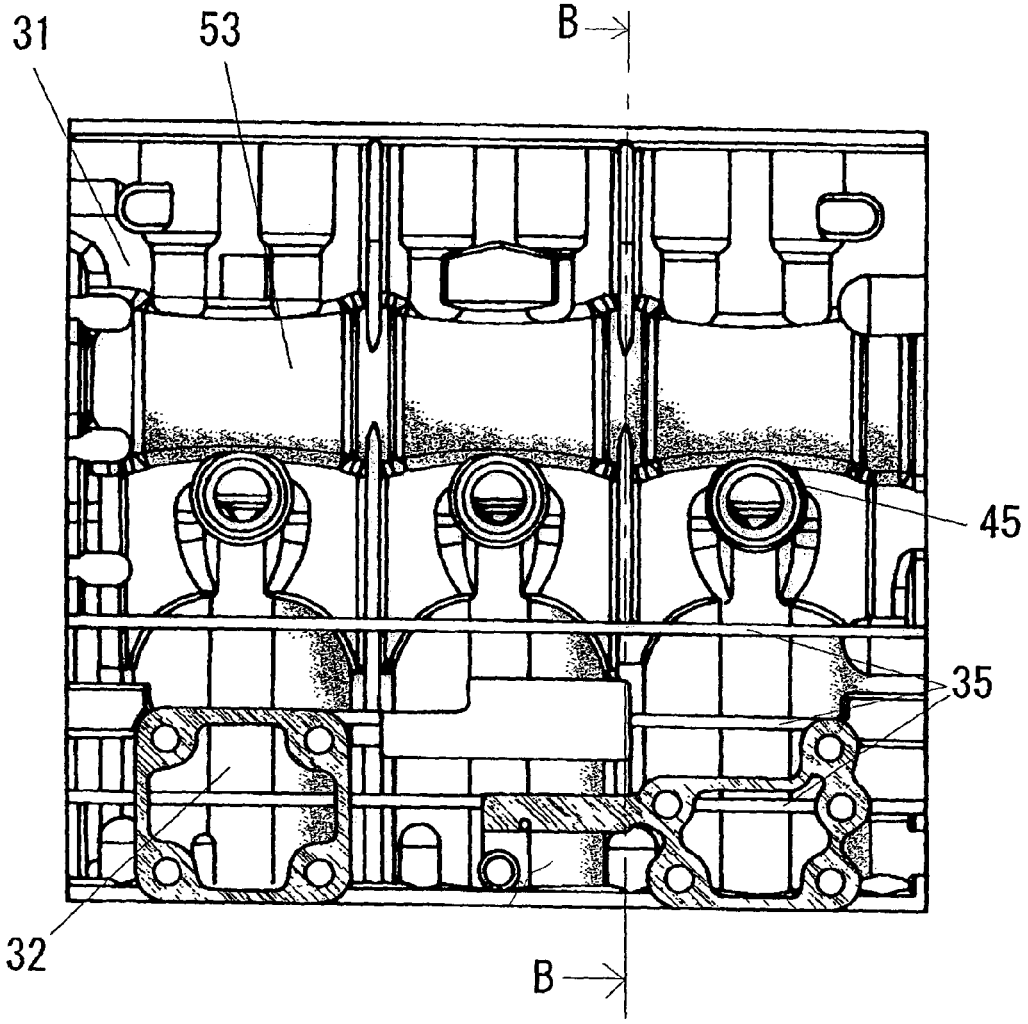
Figure 6:
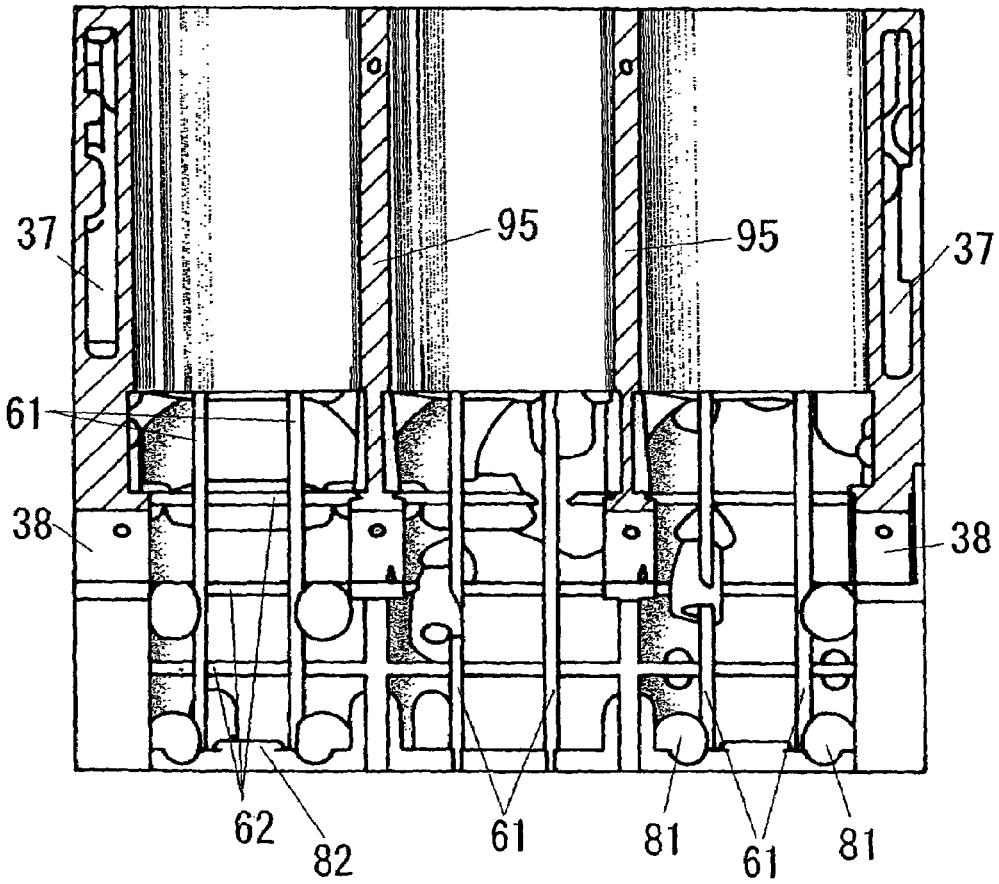
Figure 7:
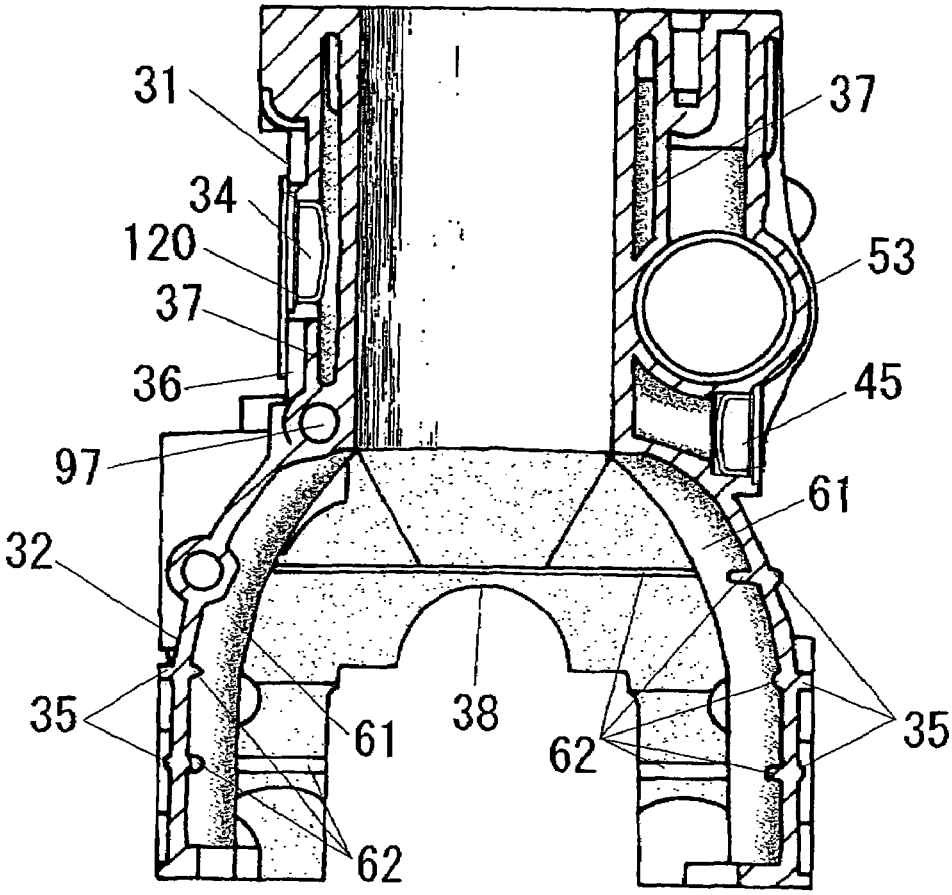

FIG. 4 is a left side view of an engine. FIG. 5 is a right side view of the same. FIG. 6 is a cross sectional side view of a cylinder block. FIG. 7 is a cross sectional front view of the same.

Figure 8:
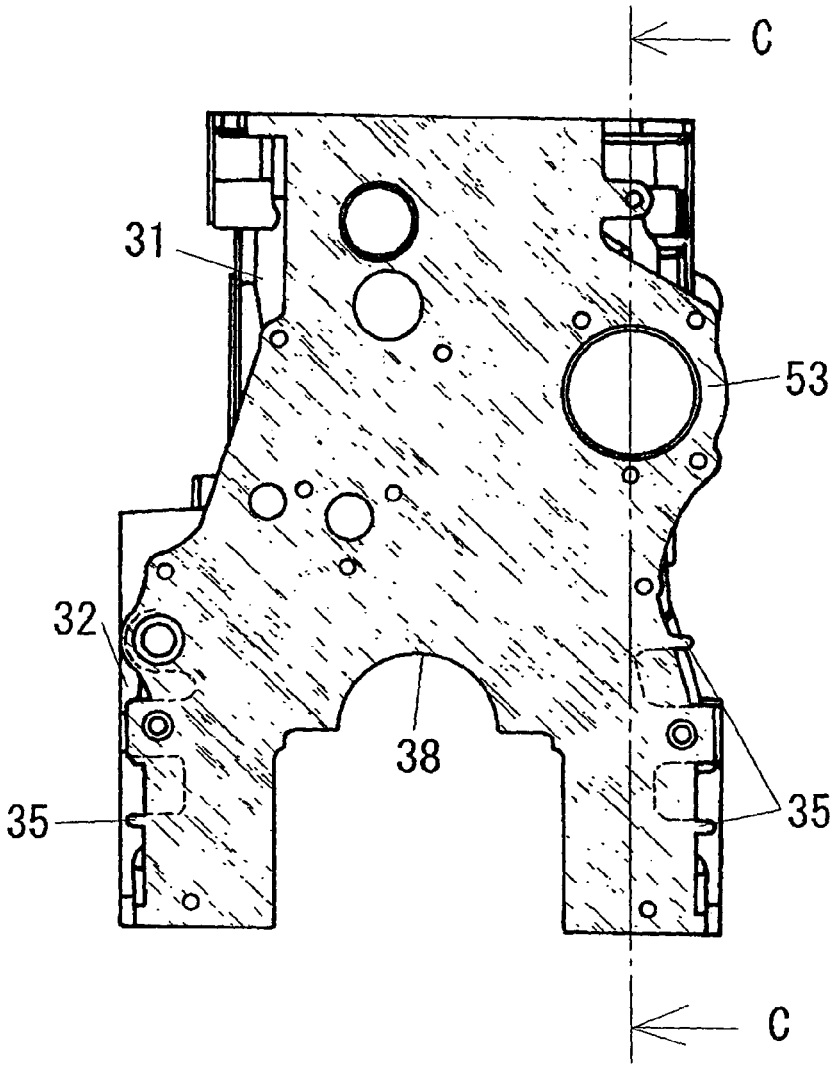

FIG. 8 is a front view of the same.

Figure 9:
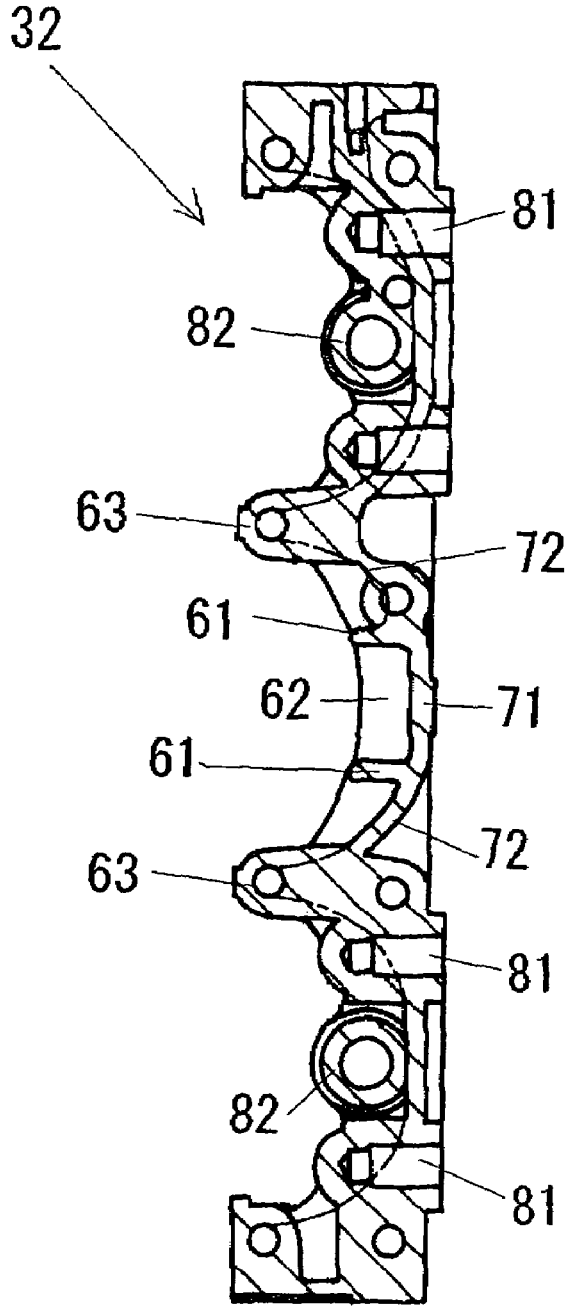

FIG. 9 is an arrow sectional view of the line D—D in FIG. 4.

Figure 10:
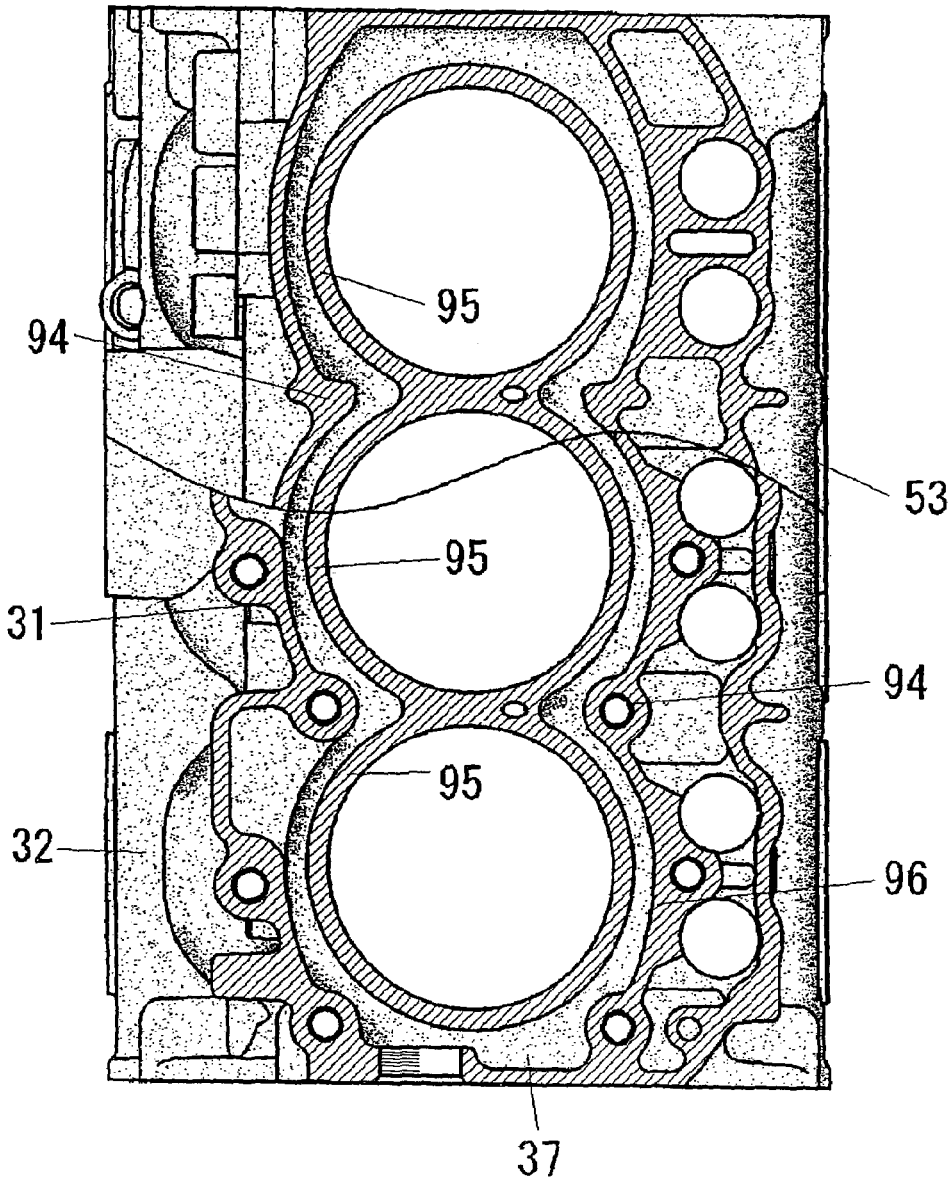

FIG. 10 is a cross sectional view of a cylinder block, showing the shape of cylinder-head-bolt bosses.

Figure 11:
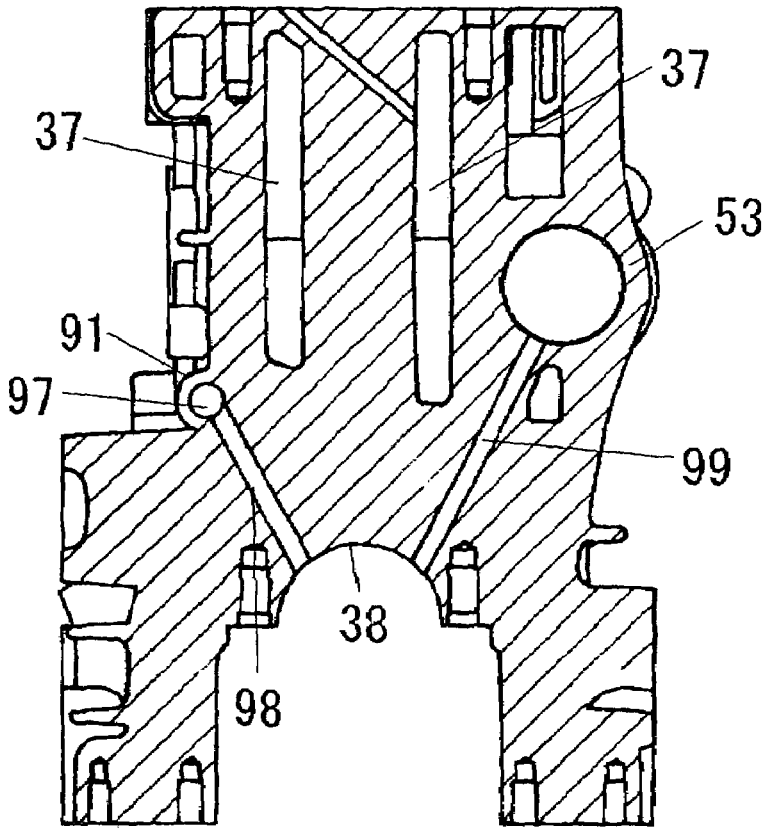

FIG. 11 is an arrow sectional view of the line B—B in FIG. 5.

Figure 12:
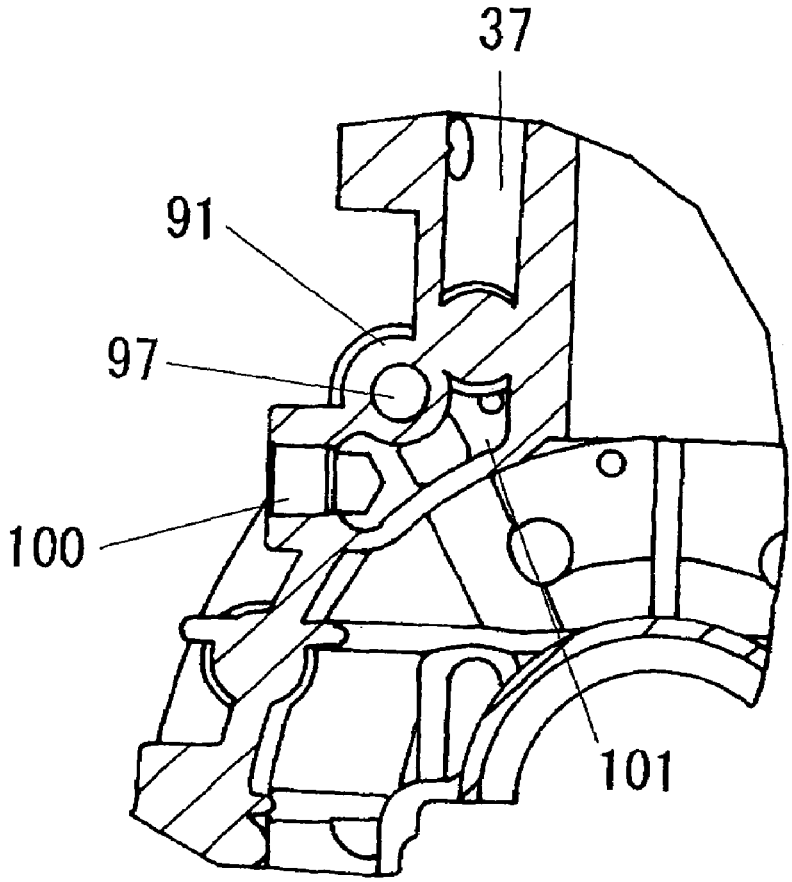

FIG. 12 is an arrow sectional view of the line A—A in FIG. 4.

Figure 13:
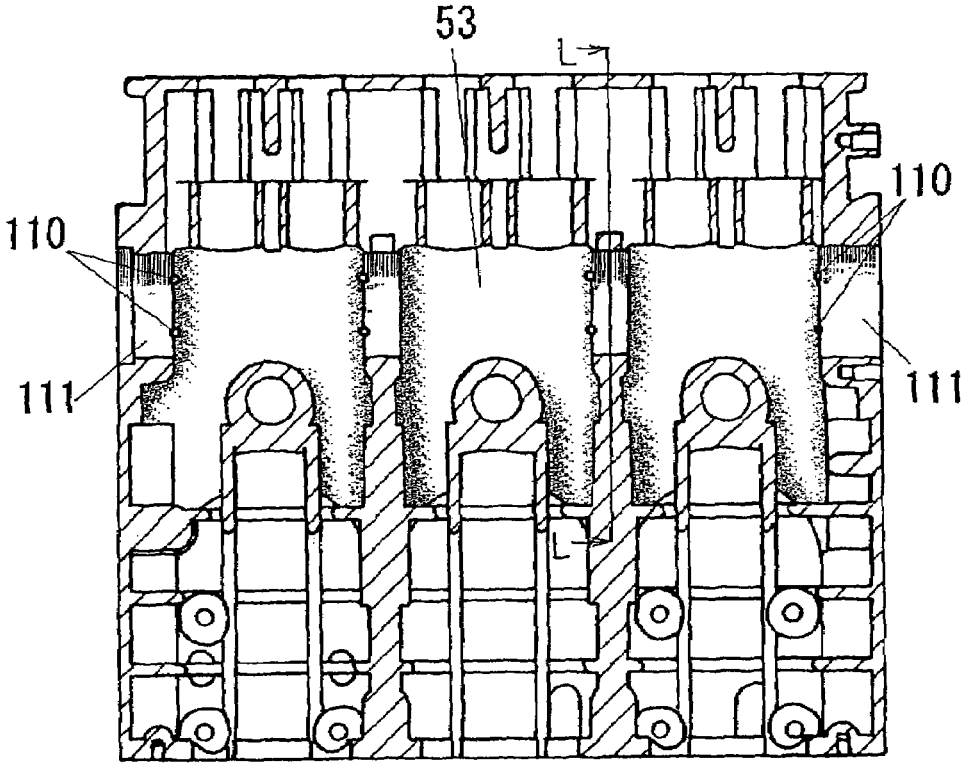

FIG. 13 is an arrow sectional view of the line C—C in FIG. 8.

Figure 14:
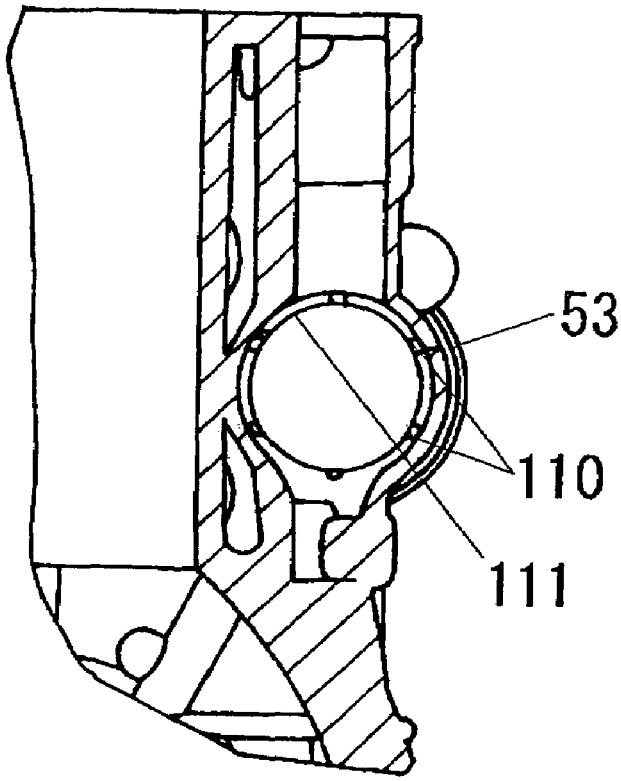

FIG. 14 is an arrow sectional view of the line L—L in FIG. 13.

Figure 15:
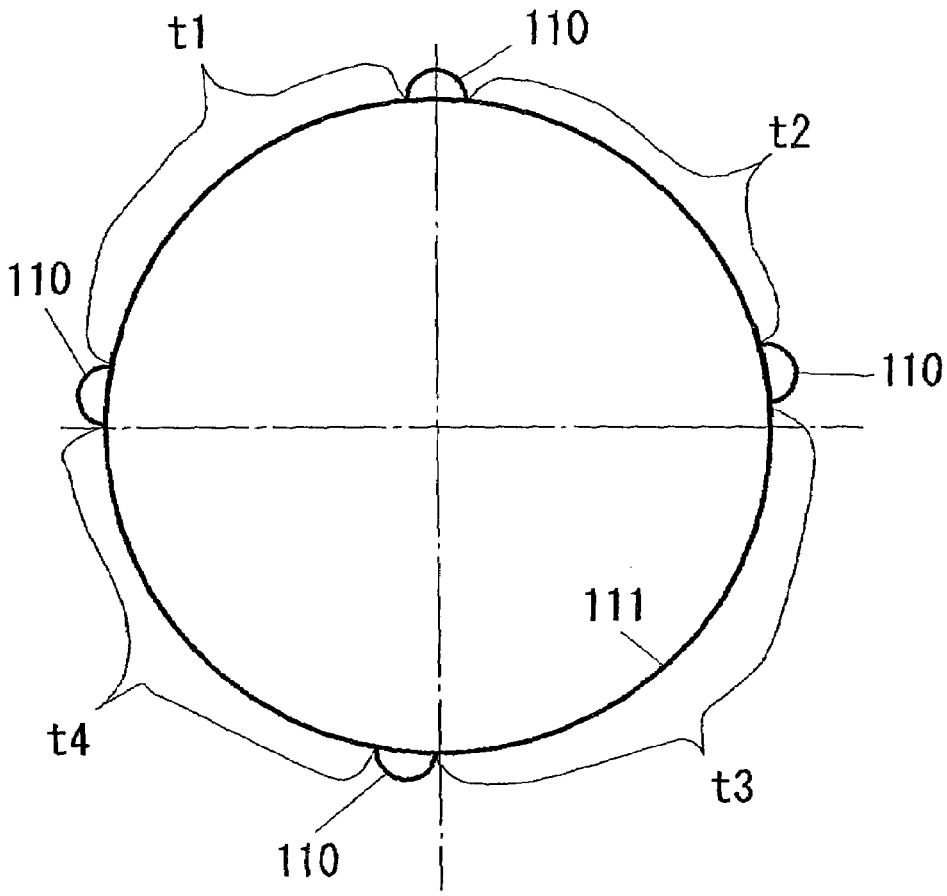

FIG. 15 is a cross sectional view of a cylinder holder, showing another arrangement of grooves formed in a cylinder holder portion.

DETAILED DESCRIPTION OF THE INVENTION

In order to expound the present invention more in detail, explanation will be given on it in accordance with drawings.

Figure 1:
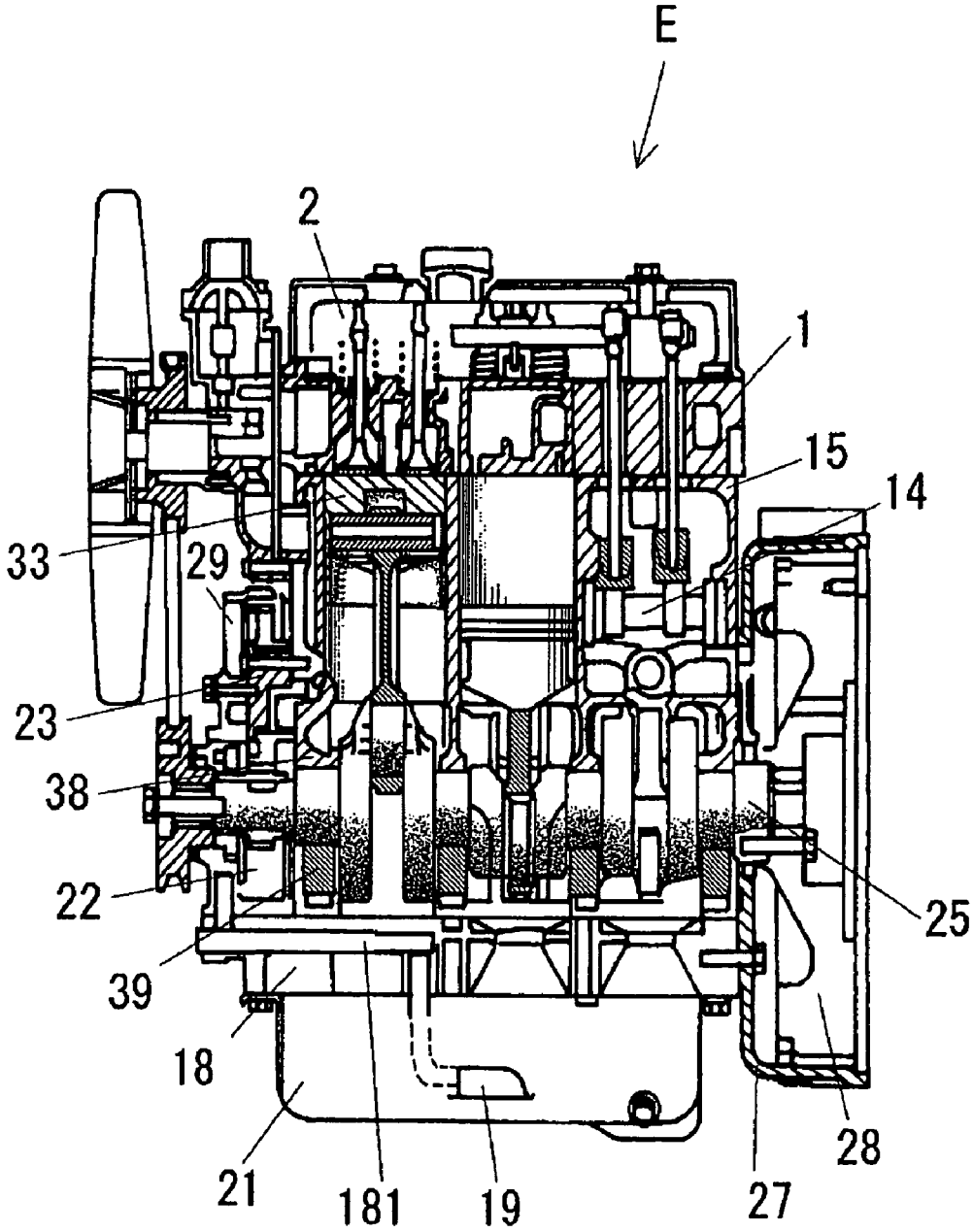
FIG. 1 is a cross sectional side view of an engine.
Figure 2:
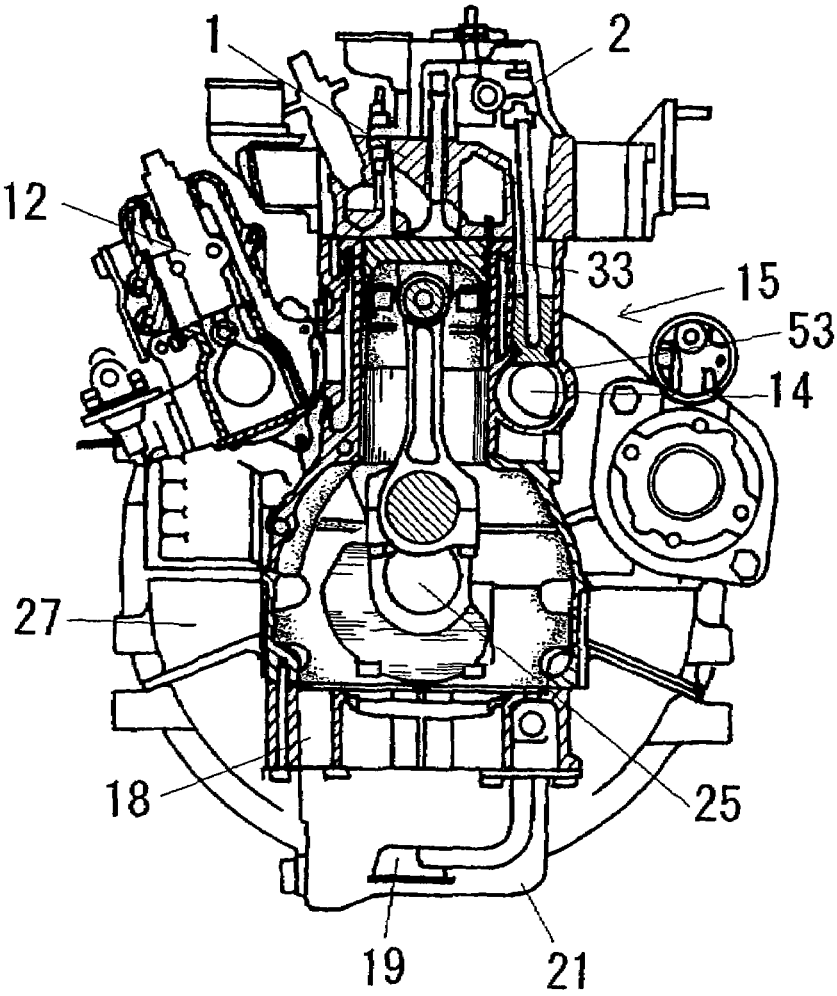
FIG. 2 is a cross sectional front view of the same.

First, explanation will be given on the outline construction of an engine in accordance with FIGS. 1 and 2. A cylinder head 1 is attached to the upper end portion of a cylinder block 15, and a rocker arm room 2 is constructed above the cylinder head 1.

A flywheel housing 27 storing a flywheel 28 is connected with one surface of the front and rear (left and right in FIG. 1) side surfaces of the cylinder block 15.

A gear case 23 for housing gears and the like is connected with the other of the front and rear side surfaces of the cylinder block 15, and the gears transmit the driving force from a crankshaft 25 to a cam shaft 14, a fuel-injection-pump 12, etc.

An oil pan 21 for storing lubricating-oil is provided below the cylinder block 15, and connected with the cylinder block 15 through a spacer 18.

The spacer 18 is extended from one of the front and rear end sides of the cylinder block 15 to the gear case 23 and a gear case cover 29. The gear case 23 connected with the cylinder block 15 and the gear case cover 29 connected with the gear case 23 are connected with the spacer 18.

A lubricating-oil intake gallery 181, which is one of lubricating-oil galleries, is formed inside the spacer 18, and open for free passage with a lubricating-oil suction pipe 19 projecting from the spacer 18 inside the oil pan 21, whereby lubricating-oil is drawn into the lubricating-oil pump 22 through the lubricating-oil suction pipe 19 and the lubricating-oil intake gallery 181.

The crankshaft 25 is supported in the lower portion of the cylinder block 15. The crankshaft 25 is journalled by journal housings 38 of the cylinder block 15 and respective metal caps 39 fixed to the cylinder block 15. Each metal cap 39 is fixed at the front and rear ends hereof to the lower portion of the cylinder block 15 between cylinders so as to upwardly support the crankshaft 25.

Figure 3:
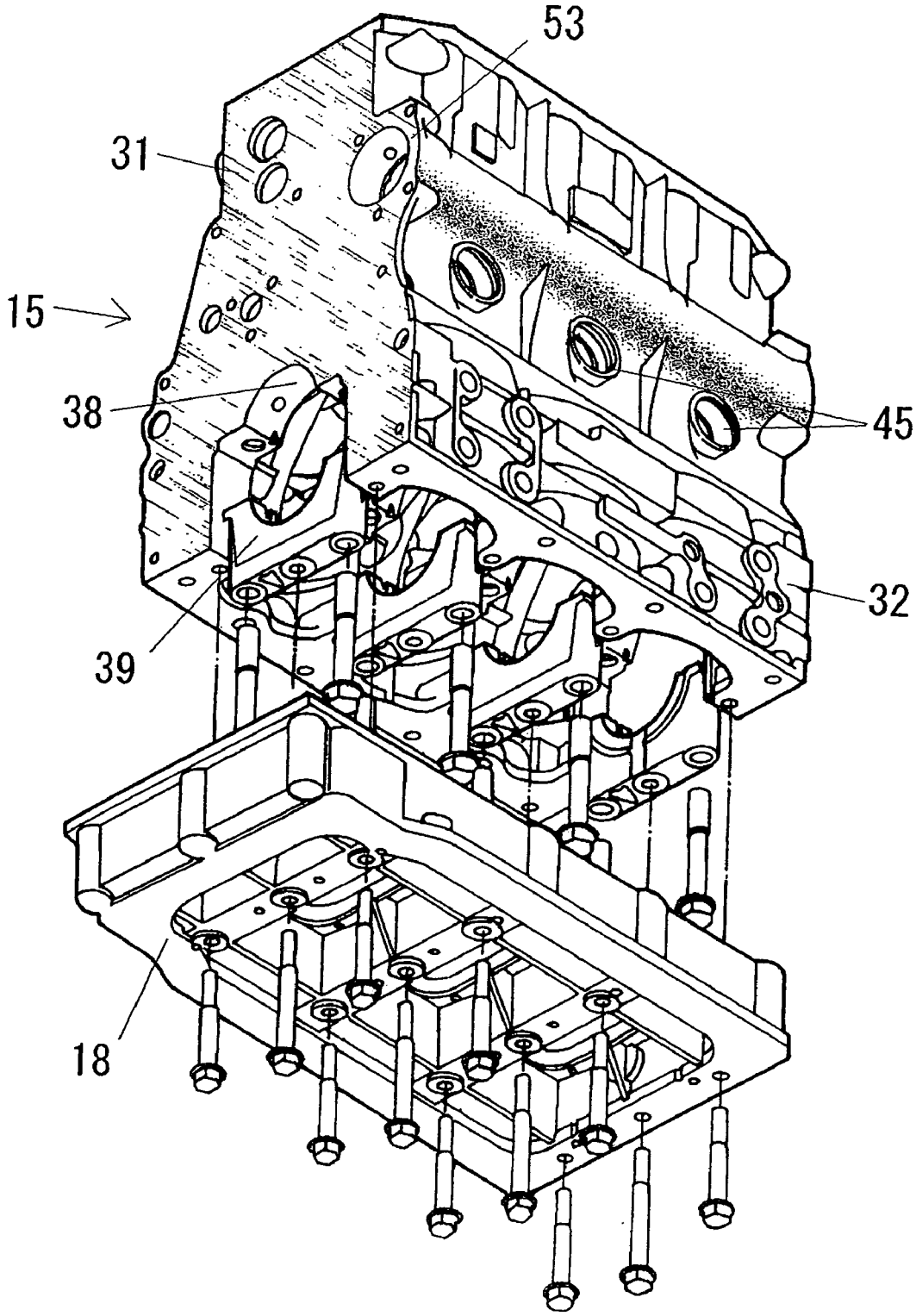
FIG. 3 is an exploded view of a cylinder block, showing the assembling construction thereof.

Next, explanation will be given on the construction of the cylinder block 15 in accordance with FIGS. 3–5 inclusive.

The cylinder block is constructed by a cylinder portion 31 and a skirt portion 32.

The cylinder portion 31 has an inner cylinder portion and an outer cylinder portion, which are integrally casted, and the pistons 33 are provided inside the cylinder portion 31. A cooling-water gallery is constructed between the inner cylinder portion and the outer cylinder portion in the cylinder portion 31, and a cam shaft case 53 is formed on one of the left and right (in the perpendicular direction to the crankshaft 25) sides of the cylinder portion 31.

Clean outs 34, 45 are formed on the left and right sides of the cylinder block 15, respectively, so as to communicate with the cooling-water gallery.

The clean outs 45 provided on the same side with the cam shaft case 53 is positioned below the cam shaft case 53 so as to construct the bottom of the cooling-water gallery.

The clean outs 34 and 45 are formed by a support member for supporting a core when the cylinder block 15 is cast. That is, in a mold, the core for forming the cooling-water gallery 37 is supported by the support member constructing the clean outs 34 and 45.

Some of the clean outs 34 and 45 are partly used as galleries for intake and drain of the cooling-water, and the others of the clean outs 34 and 45 are plugged.

The clean outs 34 and 45 serves as openings communicating with the cooling-water gallery 37 in the cylinder block 15. Hence, there is the possibility of reducing the rigidity near the clean outs 34 and 45. However, ribs are connected with the clean outs 34 and 45, thereby preventing the rigidity from reducing.

The lower portion of each cylinder is curved in the skirt portion 32. The left and right side surfaces of the skirt portion 32 are curved in a front view as shown in FIG. 7, and curved also in a plan view as shown in FIG. 9. That is, the skirt portion 32 is curved in both transverse section and vertical section.

In addition, ribs are formed on the inside and outside of the skirt portion 32 so as to enhance the rigidity of the skirt portion 32. Due to this increased rigidity, the skirt portion 32 is restrained from deforming when something is attached onto a surface thereof.

The ribs 35 are formed on the cylinder portion 31 and the skirt portion 32 of the cylinder block 15 in the front and rear direction of the cylinder block 15. The ribs 36 are formed on the cylinder portion 31 and the skirt portion 32 in the vertical direction of the cylinder block 15.

Each of the ribs is formed near a point of the cylinder block 15 to which something is fastened, thereby restraining deformation of the cylinder block 15 caused by the fastening.

The rib 35 on the cylinder portion 31 is formed near the clean out 34, where the rib 36 disposed in the vertical direction of the cylinder block 15 is also formed.

In this way, the ribs 35 and 36 are provided near the clean out 34 so as to enhance the rigidity of the cylinder block 15 near the clean out 34.

At least one of ribs 61 and 62 is connected with the plugged hole. Moreover, the skirt portion 32 is curved in a transverse section, and the rib formed outside the cylinder block is connected with the plugged hole constructed in the cylinder portion, so that the rigidity of the cylinder block near the plugged hole is enhanced, thereby restraining deformation of the cylinder block and easily improving the precision of assembling the engine.

The ribs 61 and 62 are formed inside the cylinder block 15 as shown in FIGS. 6–8 inclusive.

Inside the skirt portion 32 of the cylinder block 15, the ribs 61 are formed in the vertical direction of the cylinder block 15, and the ribs 62 in the front and rear direction thereof.

In this way, the ribs 61 and 62 are provided inside the cylinder block 15 so as to enhance the rigidity of the cylinder block 15. Moreover, the ribs 61 and 62 are provided inside the skirt portion 32 so that the inner surface shape is so complicated as to cause interference of sound, thereby reducing the noise of the engine. Also, in the outer surface of the skirt portion 32, flat portions are reduced, thereby further diffusing the noise.

The vertical ribs 61 are provided from lower end portions of the cylinder-liners to a lower end portion of the skirt portion 32 so as to enhance the rigidity of the cylinder block at the cylinder-liners and at the surface fitted to the spacer.

The ribs 61 and 62 are mainly formed below the cylinders so as to enhance the rigidity of the skirt portion 32.

In this way, the rigidity of the cylinder block is enhanced at the skirt portion 32 by constructing the ribs 35, 36, 61, and 62 while the cylinder block 15 is light-weighed by constructing the skirt portion 32 thinly.

Furthermore, some of the vertical ribs 61 are formed on the cylinder block 15 continuously from respective bosses 81 for attachment of an engine base. Due to the vertical ribs 61 integrally connected with the bosses 81, the rigidity of the cylinder block 15 is enhanced at the bosses 81.

Therefore, the cylinder block is restrained from deforming at the time of its attachment to the engine base so as to improve the precision of assembling the engine.

Moreover, the journal housings 38 for supporting the crankshaft are constructed in the skirt portion 32.

Each journal housing 38 supports the crankshaft 25 together with the metal cap 39 fixed to the lower portion of the cylinder block 15.

Each journal housing 38 is formed by the cylinder block 15 at the front and rear surfaces thereof and each cylinder thereof. The journal housings 38 on respective sides of the cylinder block 15 toward of the gear case 23 and the flywheel 28 are thickened at their upper portions.

Therefore, while casting process of the cylinder block 15 is simplified, the rigidity of the cylinder block 15 is enhanced and the noise of the engine is reduced.

In this way, while the cylinder block has the surface facing the flywheel and the surface to be connected to the gear case, the journal housings on the respective sides toward the surfaces are thickened at their upper portions. Therefore, the rigidity of the cylinder block is enhanced so that the deformation thereof when it is attached to the engine base is restrained and the precision of assembling the engine is improved, thereby ensuring the rotational stability of the crankshaft and improving the silence of the engine.

Locating bosses 82 are formed at the lower portion of the skirt portion 32, and are made thicker than other portion of the skirt portion 32. The locating bosses 82 are formed with the ribs inside the skirt portion 32. By forming the locating bosses 82 inside the skirt portion 32, a mounting seat of the engine E is not projected outward and the engine E is constructed compactly in width. Moreover, the skirt portion 32 curved to swell outward in a transverse section is enhanced in rigidity by such an easy manner as to form the ribs therein.

The journal housings 38 are formed below the cooling-water gallery 37 as shown in FIG. 6, and constructed so as not to project either toward the crankcase or the flywheel. Therefore, the conventional crankcase and flywheel can be installed onto the present cylinder block 15.

Furthermore, a space of the cylinder block 15 is used effectively so as to enhance the rigidity thereof and reduce the noise of the engine, thereby improving the engine performance while maintaining the engine compact.

Therefore, the weight of the cylinder block 15 is reduced so as to facilitate for weight saving of the engine.

Next, explanation will be given on the construction of the skirt portion 32 in accordance with FIG. 9 in more detail.

The skirt portion 32 is curved outward in a front view and a plan view. The ribs are provided on both inside and outside surfaces of the skirt portion 32, so that the rigidity thereof is improved. The skirt portion 32 is comprised of curving structures as known from a plan view, which are as many as the cylinders, are connected in series, thereby being enhanced in rigidity. The above-mentioned ribs further enhance the rigidity thereof.

Each of the curving structures of the skirt portion 32 is comprised of end portions 72 and a middle portion 71 therebetween. The horizontal ribs 62 are connected with the middle portion 71 and the end portion 72, and each of the vertical ribs 61 is constructed between the middle portion 71 and each of the end portion 72.

The curvature of the middle portion 71 in plan view is set gentler than the end portion 72. Therefore, a region 63 connecting the cylinders is so shaped as to be connected smoothly to the end portions 72. Sand for molding is hard to remain between the region 63 and the end portion 72, thereby making the production process of the cylinder block 15 easy.

The curve structure of the skirt portion 32 not only improves the rigidity thereof but also diffuses the noise emitted from the skirt portion 32. The skirt portion 32 is constructed by the curve structure, so the noise emitted therefrom is diffused radially from the surface of the skirt portion 32, and reduced with the increasing distance from the skirt portion 32.

Therefore, noise emitted from the engine is not enlarged locally so that the silence of the engine is improved.

A main gallery of lubricating-oil is constructed inside a lubricating-oil case 91, which is provided in a side portion of the cylinder block 15 (as shown in FIG. 11).

The lubricating-oil case 91 is disposed in the middle of the side portion of the cylinder block 15 along the direction of arrangement of the cylinders, and integrally formed by the cylinder block 15.

Next, explanation will be given on the construction of the clean outs 34 and 45 in accordance with FIG. 7 in more detail.

The clean outs 34 and 45 are spot-faced so as to improve the precision of processing of the clean outs 34 and 45 in the cylinder block 15.

When the cylinder block 15 is constructed by casting, there may arise such a case where the outer side portions of the clean outs 34 and 45 are recessed in a bowl-like shape. In this case, the outer sides thereof are spot-faced so as to keep the shapes of the clean outs 34 and 45 constant, thereby improving the precision thereof to be plugged, enhancing the rigidity of the cylinder block 15, and improving the durability thereof by preventing leak of cooling-water.

Next, explanation will be given on the construction of the cooling-water gallery in accordance with FIGS. 6, 7, and 10 in detail.

The cooling-water gallery 37 constituting a water jacket is provided in the cylinder block 15, and the water jacket is extended to the crankcase portion. Therefore, the capacity of the water jacket is increased so as to enhance the cooling effect of the crankcase portion.

The water jacket shuts off noise from the inside thereof so as to reduce noise emitted outward from the engine.

The cooling-water gallery 37 is constructed on the left and right sides of the cylinders 95, and on the front and rear ends of the cylinders 95 so as to be connected in the front and rear direction.

The cooling-water gallery 37 is constructed along the outer side surfaces of the continued cylinders 95, and an outer wall 96 constituting the outside of the cooling-water gallery 37 is constructed so as to cover the continued cylinders 95. Each of cylinder-head-bolt bosses 94 is formed in the outer wall 96 positioned between the cylinders 95.

The upper portion of the cylinder-head-bolt boss 94 touching the cooling-water gallery 37 is formed approximately symmetrically in the front and rear direction in order to support a bolt for fastening the cylinder head, while the lower portion thereof is formed non-symmetrically in the front and rear direction of the cylinder block 15.

The lower portion of the cylinder-head-bolt boss 94 includes one of the front and rear sides thereof formed along the cylinder 95 to some degree, and the other thereof recessed inward (apart from the cylinder 95). That is, the shape of the cylinder-head-bolt boss 94 differs between the upstream and downstream sides of the cooling-water gallery 37.

The cylinder-head-bolt bosses 94 are shaped to turn the flow direction of cooling-water to the portion between the cylinders 95.

Therefore, the cooling-water flows into the cooling-water gallery 37 so as to be smoothly supplied into the portion between the cylinders, thereby enhancing its cooling effect.

Next, explanation will be given on the construction of the cooling-water jacket in accordance with FIGS. 11 and 12 in detail.

As mentioned above, the lubricating-oil gallery 97 is constructed inside the lubricating-oil case 91, which is provided on the side portion of the cylinder block 15. The lubricating-oil gallery 97 is connected with the journal housings 38 by the oil passage 98, and the interior of camshaft case 53 is also connected with the journal housings 38 by oil passages 99.

Therefore, it is possible to maintain the lubrication between the crankshaft 25 and the cylinder block 15.

The cooling-water gallery 37 is constructed above the lubricating-oil gallery 97 in the cylinder block 15.

However, as shown in FIG. 12, a drain hole 100 of the cooling-water connected with the cooling-water gallery 37 is positioned below the lubricating-oil gallery 97.

Therefore, the drain hole 100 is located at the lowest position in the cooling-water gallery 37 so that the cooling-water may be efficiently discharged from the cooling-water gallery 37 into the cylinder block 15 through the drain hole 100.

The drain hole 100 is connected with the cooling-water gallery 37 through a cooling-water drain gallery 101. The cooling-water drain gallery 101 connects the cooling-water gallery 37 and the drain hole 100 inside the lubricating-oil gallery 97.

Therefore, efficient drain of cooling-water is ensured without changing the construction of the lubricating-oil gallery 97. Moreover, the cooling-water does not remain inside the cooling-water gallery 37, thereby preventing degradation of the cylinder block.

In addition, the water jacket constructed by the cooling-water gallery is extended to the below of the lubricating-oil gallery so as to increase an area of the lubricating-oil gallery close to the water jacket, thereby improving the cooling effect to the lubricating-oil gallery.

Next, explanation will be given on the construction of the camshaft case in accordance with FIGS. 8, 13, and 14 in detail.

Grooves 110 are constructed inside the camshaft case 53. The camshaft 14 is provided in a columnar space, which is extended in the front and rear direction of the cylinder block 15 and constructed inside the camshaft case 53. Spaces opening in the vertical direction are provided in the upper portion of the space where the camshaft 14 is disposed, and push rods are provided in the respective vertical spaces.

Holder portions 111 are constructed inside the camshaft case 53 so as to hold the camshaft 14.

After the cylinder block 15 is cast integrally with the holder portions 111, the holder portions 11 are processed so as to have smooth and constantly shaped surfaces, thereby supporting the camshaft 14 smoothly.

As the processing after casting, cutting is mainly carried out. In cutting, the inner side surfaces of the holder portions 111 are cut by the cutting tool.

In the cast cylinder block 15, each of the holder portions 111 is formed on the inner periphery thereof with a plurality of grooves 110 at irregular intervals so as to prevent burrs etc. when the cutting is applied to the holder portions 111.

Therefore, impact is transmitted to the cutting tool at irregular intervals so as to restrict judder and chatter of the cutting tool in cutting the holder portion 111, thereby improving the precision of cutting the holder portions 111 so as to reduce friction loss in the cylinder block 15.

Moreover, the burrs and abatements generated in the processing are separated from the holder portion 111 into the grooves 110 and do not remain on the surface of holder portion 111, thereby simplifying the work for removing them.

Next, explanation will be given on other construction inside the holder portion 111 in accordance with FIG. 15.

Four grooves 110 are provided at respective positions in the holder portion 111 as shown in FIG. 15. Intervals t1, t2, t3, and t4 between the grooves 110 differ from one another.

The upper groove 110 is constructed at the upper end of the holder portion 111. The lower groove 110 is shifted leftward at a little from the lower end of the holder portion 111 making symmetry together with the upper groove 10 with respect to the axis of the holder portion 111. The left groove 110 is shifted upwardly leftward from the lower groove 110 at about 90° around the axis of the holder portion 111. The right groove 110 is opposed to the left groove 110 but higher than the left groove 110.

Therefore, the intervals t1, t2, t3, and t4 between the grooves 110 are different from one another so that the impact transmitted to the cutting tool becomes irregular so as to restrict judder and chatter of the cutting tool in cutting the holder portion 111. The arrangement of the grooves 110 may be also adapted to other portions such as holes under the liners. For example, the above-mentioned plugged hole may be provided on the inner periphery thereof with axial grooves 110 at irregular intervals so as to improve precision of cutting the plugged hole. Alternatively, the grooves 10 may be constructed in another direction about a hole to which they are provided. For example, they may be aligned in parallel in the axial direction of the hole, or they may be disposed slantwise. Alternatively, they may be made into a shape of steps. Any shape of the grooves is appreciated if it is considered so as to reduce impact onto a cutting tool when the cutting work. The shape of the grooves is not limited to the above-mentioned constructions.

The irregular intervals among the grooves 110 makes intervals of impact to the cutting tool irregular so as to restrict judder and chatter caused by resonation of the cutting tool with the impact.

INDUSTRIAL APPLICABILITY OF THE INVENTION

As mentioned above, the cylinder block according to the present invention is adaptable for engines such as a diesel engine.

What is claimed is:

1. A cylinder block of an engine, comprising:

a cylinder portion adapted to house at least one piston within an inner portion of the cylinder portion;

a curved skirt portion integral with the cylinder portion and forming a housing for a crankshaft;

a clean out hole formed on the outer surface of the cylinder portion and adapted to receive a plug; and a rib formed on the outside surface of the cylinder portion so as to extend from the clean out hole.

2. A cylinder block of an engine as set forth in claim 1, further comprising:

a surface facing a flywheel;

a surface connected to a gear case; and journal housings for supporting said crankshaft, wherein journal housings on respective sides of the cylinder blocks toward the surfaces are thickened at the upper portions thereof.

3. A cylinder block of an engine as set forth in claim 1, wherein the clean out hole spot-faced.

4. A cylinder block of an engine as set forth in claim 1, further comprising:

a second rib formed on the inside surface of the skirt portion.

5. A cylinder block of an engine as set forth in claim 4, further comprising:

a boss for attaching an engine base to the cylinder block, wherein the second rib is provided continuously from the boss.

6. A cylinder block of an engine as set forth in claim 1, further comprising:

a water jacket disposed in said cylinder portion, wherein the water jacket extends into said skirt portion.

7. A cylinder block of an engine as set forth in claim 6, further comprising:

a lubricating-oil gallery, wherein the water jacket is extended to a point below the lubricating-oil gallery.

8. A cylinder block of an engine as set forth in claim 6, further comprising:

a lubricating-oil gallery; and a drain hole of cooling water disposed below the lubricating-oil gallery.

9. A cylinder block of an engine, comprising:

a cylinder portion adapted to house at least one piston within an inner portion of the cylinder portion;

a curved skirt portion integral with the cylinder portion and forming a crankcase housing to thereby house a crankshaft which is coupled to at least one piston; and a rib formed on the inside surface of the skirt portion.

10. A cylinder block of an engine as set forth in claim 9, wherein the rib is formed to extend in a horizontal direction, relative to the cylinder block, along the inside surface of the skirt portion.

11. A cylinder block of an engine as set forth in claim 9, wherein the curved skirt portion is curved in a vertical plane.

12. A cylinder block of an engine as set forth in claim 9, wherein the curved skirt portion is curved in a horizontal plane.

13. A cylinder block of an engine as set forth in claim 9, wherein the rib is formed to extend in a vertical direction, relative to the cylinder block, along the inside surface of the skirt portion.

14. A cylinder block of an engine as set forth in claim 13, further comprising:

a second rib formed on the inside surface of the skirt portion and extending in a horizontal direction relative to the cylinder block.

15. A cylinder block of an engine as set forth in claim 9, wherein the curved skirt portion is curved in both a vertical plane and a horizontal plane.

16. A cylinder block of an engine as set forth in claim 15, further comprising:

a clean out hole formed on the outer surface of the cylinder portion, wherein the clean out hole is spot-faced; and a second rib formed on the cylinder portion so as to extend from the clean out hole.

17. A cylinder block of an engine as set forth in claim 16, further comprising:

a boss for attaching an engine base to the cylinder block, wherein the rib formed on the inside surface of the skirt portion is provided continuously from the boss.

18. A cylinder block of an engine as set forth in claim 17, further comprising:

a surface facing a flywheel;

a surface connected to a gear case; and journal housings for supporting said crankshaft, wherein journal housings on respective sides of the cylinder blocks toward the surfaces are thickened at the upper portions thereof.

19. A cylinder block of an engine as set forth in claim 18, further comprising:

a water jacket disposed in said cylinder portion, wherein the water jacket extends into said skirt portion;

a lubricating-oil gallery, wherein the water jacket is extended to a point below the lubricating-oil gallery; and a drain hole of cooling water disposed below the lubricating-oil gallery.

* * * * *